US005293205A

United States Patent [19]

Plasschaert et al.

[11] Patent Number: 5,293,205

[45] Date of Patent: Mar. 8, 1994

[54] SIDE TO SIDE SHEET INVERTER

[75] Inventors: Paul E. Plasschaert, Limehouse; Jeffrey P. Belbeck, Mississauga, both of Canada

[73] Assignee: Delphax Systems, Canton, Mass.

[21] Appl. No.: 819,826

[22] Filed: Jan. 13, 1992

[51] Int. Cl.[5] ..... G03G 21/00

[52] U.S. Cl. ..... 355/318; 271/291

[58] Field of Search ..... 355/308, 309, 318, 319, 355/24, 26; 271/291, 65, 185, 184, 186, 225; 226/197

[56] References Cited

U.S. PATENT DOCUMENTS

| | | | |
|---|---|---|---|
| 3,137,499 | 6/1964 | Maidment | 271/185 |
| 3,548,283 | 12/1970 | Knapp | 226/197 X |
| 3,583,621 | 6/1971 | Bryant | 226/197 X |
| 4,078,489 | 3/1978 | Davis | 271/186 X |
| 4,262,897 | 4/1981 | Kopacz | 271/185 |
| 4,844,442 | 7/1989 | Gämmerler | 271/186 X |
| 4,879,571 | 11/1989 | Plasschaert | 355/26 |
| 5,026,037 | 6/1991 | Masuda | 355/319 X |
| 5,196,896 | 3/1993 | Hamakawa | 355/309 |

*Primary Examiner*—A. T. Grimley
*Assistant Examiner*—Nestor R. Ramirez
*Attorney, Agent, or Firm*—Lahive & Cockfield

[57] ABSTRACT

A sheet transport for a printer moves the leading edge of a sheet along a short and substantially straight path while inverting the sheet side-to-side. An output path feeds back to the printer input so a second side is printed in the correct orientation. Preferably a non-inverting sheet transport feeds directly into the output path, so that a once-printed sheet is transported to another printer, or is returned to the printer for a second pass either inverted, or on the same side. A deflector curls the sheet over a bar onto a transport at a different level, and as the paper advances, its trailing edge is drawn over the bar, flipping the sheet over.

12 Claims, 4 Drawing Sheets

SIDE TO SIDE SHEET INVERTER

BACKGROUND OF THE INVENTION

The present invention relates to devices for transporting sheets in or between printers, and more particularly to sheet handlers, feeders, and sheet transport mechanisms which are built into or added onto systems composed of one or more printers. It particularly relates to two-sided printing systems.

Among prior art printing or copying systems, it is common to provide, at the output of one print "engine" a transport mechanism to carry sheets that have been printed on one side, and to function as a collating, inverting or other specialized sheet handling system. U.S. Pat. No. 4,879,571 issued to one of the present inventors, Paul Plasschaert, shows one such specialized sheet handling system wherein an entering sheet from the output of one print engine is inverted side-to-side as it undergoes a right angle change in transport direction.

The inverting system described in that patent operates by driving a front corner of the moving sheet against a J-bar that extends into the paper path to initiate a curling-over of the corner. As the sheet continues to advance along the transport path, the curled-over edge pushes against an obstruction oriented at 45° across the transport path, which causes the leading end to continue curling over as it makes a right angle turn into the output path. That transport allows the injection of half-printed (e.g., single-side printed) sheets from a side station, into a main printing line with the sheets flipped over for receiving a second print image, thus offering greater flexibility in configuring multi-printer systems.

It would also be desirable to flip a printed sheet without changing its transport direction, and preferably to do so in a short transport path.

SUMMARY OF THE INVENTION

A sheet inverter for use in a printing system in accordance with the present invention includes first and second sheet drivers located along a substantially straight transport path, and a curl bar for curling over a leading edge of a sheet as it is driven by the first sheet driver. The second sheet driver is positioned to capture the curled-over sheet and draw it along at a slightly higher level over a guide bar that angles out from the transport axis. As the sheet is drawn along, the opposite side trailing corner is pulled over the guide bar, completely inverting the sheet in a side-to-side sense. A system according to the invention for producing two-sided prints may use two substantially identical print engines with the inverter connected between the output of the first engine and the input of the second engine. A preferred system, however, employs the inverter in a sheet return path extending from the output to input of a single print engine, to provide already printed sheets back into the printing path.

For that embodiment, the inverter preferably further includes a non-inverting path into which the once-printed sheets may be directed when a second printing operation, such as a highlight color operation, is to occur on the same side of the sheet. The non-inverting path feeds the sheet directly in at the second sheet driver, rather than at the input path to the first sheet driver and curl bar. Thus, both an inverting and a non-inverting transport path, can be selected to transport a sheet from the print engine output to its input.

DETAILED DESCRIPTION OF THE INVENTION

Figure 1:
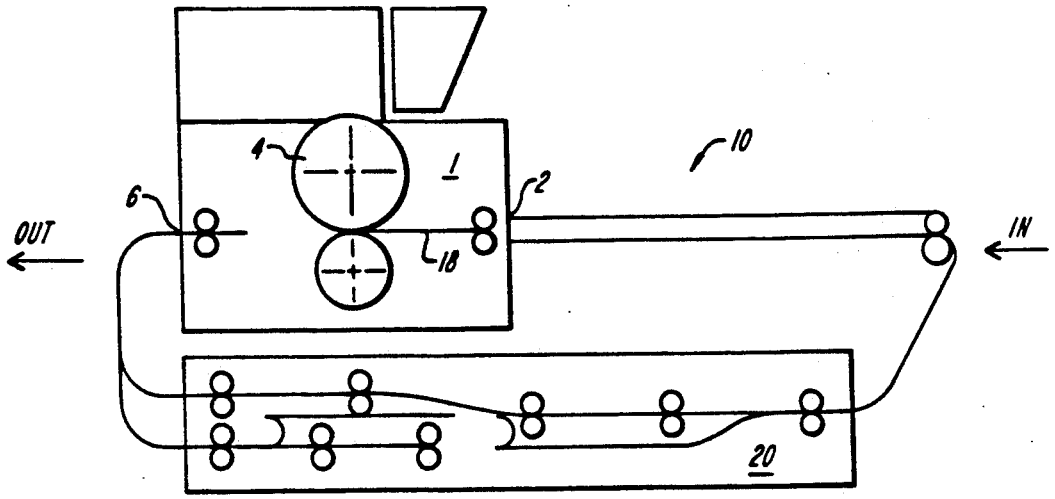
FIG. 1 shows a preferred printing system and sheet inverter in accordance with the present invention.

As shown in FIG. 1, a printing system 10 incorporating a sheet transport according to the invention includes a print engine 1 having an input path 2, an imaging assembly 4, and an output path 6 such that sheets 18 delivered to the input path 2 are imprinted with an image by the imaging assembly and transported along the output path 6. Paths 2, 6 may include feed rollers, moving belts or other known transport mechanisms. A sheet transport unit 20 extends between the output path 6 and the input path 2, and serves to transport already-printed sheets back to the input for further printing. In accordance with a basic embodiment of the invention, the transport unit 20 transports the sheet along a straight line path such that the leading edge of a sheet leaving output path 6 remains the leading edge as the sheet is transported to the input path 2, while unit 20 flips the sheet in a side-to-side sense.

Figure 2:
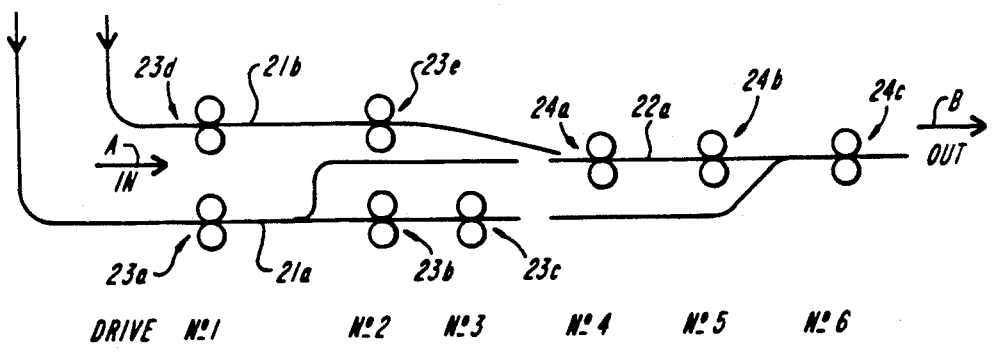
FIG. 2 shows a detail of the sheet inverter with two inlets of FIG. 1.

This is accomplished by providing a plurality of guide plates that define a sheet transport channel **21*a* for a sheet input, and a sheet transport channel 22*a* located at a vertically offset level from path 21*a*, as shown in FIG. 2. As a sheet 18 is transported along path 21*a* by transport roller sets 23*a*, 23*b*, 23*c* a side of its leading edge is curled over into the offset path 22*a*. Thereafter, a second set of transport roller sets 24*a*, 24*b*, 24*c* engage the curled over edge and pull the sheet in alignment along path 22*a***, completing the flip-over of that sheet. The use of multiple roller pairs in each path serves to maintain a straight orientation of the sheet as it travels along its flipping path between input A and output B.

In the illustrated embodiment, a parallel input path **21*b* with transport roller pairs 23*d*, 23*e* provides a second input that also feeds into the output path 22*a*. This path feeds into the output path 22*a*** at a shallow angle to essentially feed sheets along a straight-through path from the printer output to the input for a second pass without flipping, as described further below.

Figure 3:
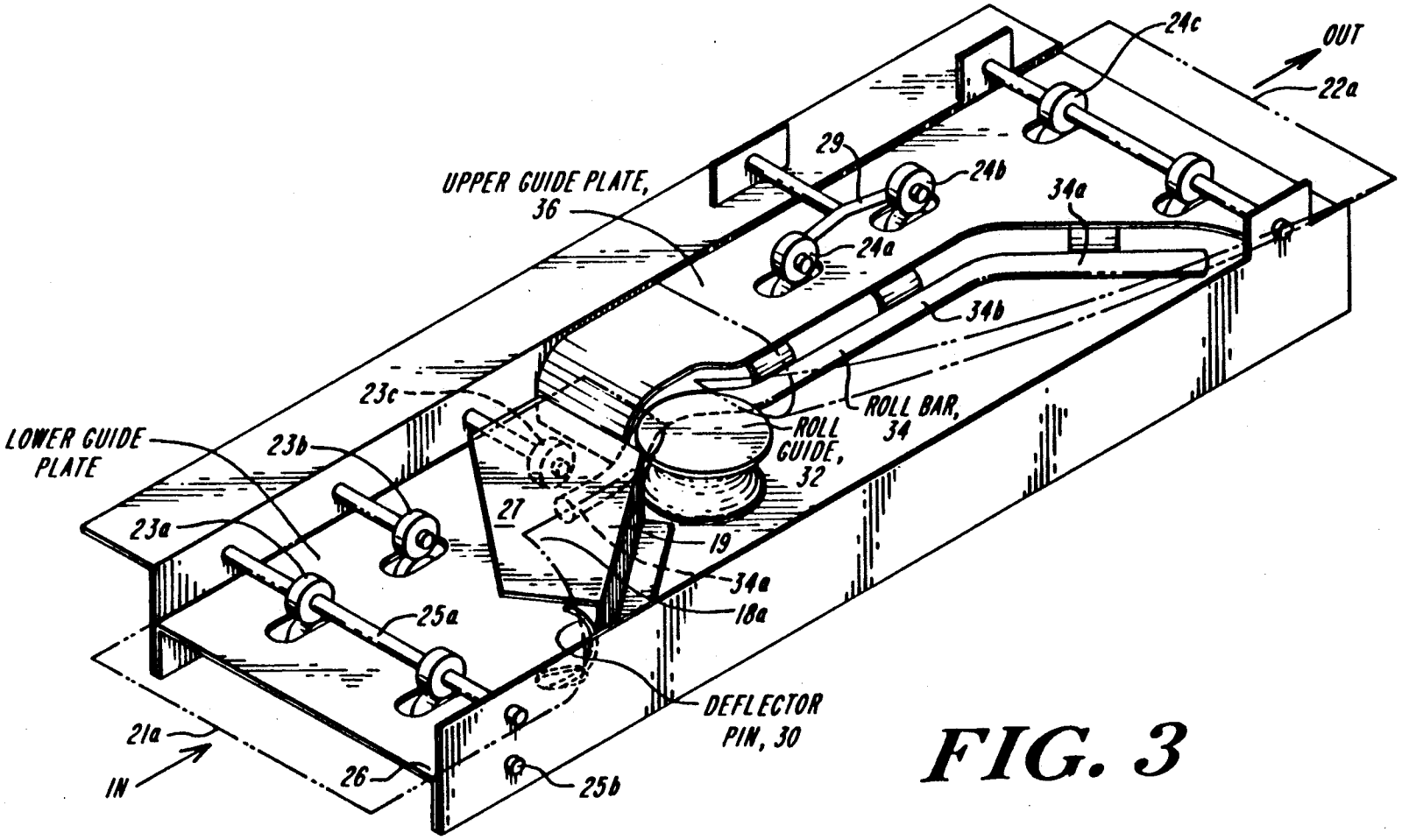
FIG. 3 shows a perspective view of the inverting portion of the mechanism of FIG. 2.

The operation of the lateral flip-over operation occurring as the sheet passes from path **21*a* to path 22*a* is best seen in the perspective view of FIG. 3. The upper guide plates and rollers defining input feed path 21*b*** are removed for clarity of illustration.

In the illustrated portion of the mechanism, a lower guide plate 26 serves as a platen along which a sheet is driven by the previously described transport rollers in path **21*a***. As shown, each set of transport rollers consists of one or more upper rollers, each of which is opposed to a corresponding lower roller to grip the sheet therebetween and drive it along the platen.

The first set of rollers 23a consists of one drive pair on an upper axle 25a, and one drive pair on a lower axle 25b. The two axles may both be driven, synchronously in opposite senses, so that the sheet is gripped between each set of upper and lower rollers and driven straight along the path. Preferably, however, one axle is driven, while the other carries idler rollers. The second and third sets of drive rollers have a rocking support mechanism, best seen in the upper part of transport drives 24a, 24b, that holds an idler roller above each of the lower driven rollers. All of the lower rollers are driven synchronously, so that the sheet is carried along at a uniform speed by successive engagement with each set of rollers, while the double rollers 23a, 24c at the input and output assure that the sheet enters and leaves the transport in a straight path without fishtailing.

Operation of the mechanism proceeds as follows. After the leading edge of sheet 18 passes transport rollers 23a, the right leading corner 18a of the sheet contacts a deflector pin 30 which hooks upward in its path, and curls the sheet over so that it progressively bends as it advances. The curled over corner 18a is caught under a guide cover 27 formed of sheet metal and having a Z-shape in vertical section. The cover forces the corner to lie in a plane parallel to and above its original path. The side wall of the guide cover is disposed obliquely inward toward a stationary roll guide 32 so that the bend in the sheet forms a shoulder 19 which, as it lengthens, fits against the concave face of the roll guide 32, located upstream from the deflector pin and closer to the center line of the transport path. The pressure of the roll guide at this position causes the sheet to curl over further, so that the curled-over right front corner 18a is brought entirely over into a position aligned with the left edge of sheet 18. During this stage of advance, pressure from the transport rollers 23a, 23b cooperates with other elements, as described below with regard to FIG. 4, to bring the sheet into the proper orientation and maintain the sheet in alignment.

As the leading corner 18a curls over, it comes to rest on upper guide plate 36 and is gripped by the first of the output transport path drive roller pairs 24a. Shoulder 19, meanwhile, curves around and over a roll bar 34, an elongated curved rod that has a proximal end 34a located to catch and orient the shoulder or bend in the sheet as it advances. Roll bar 34 has an extended central portion 34b oriented parallel to the paper path that helps to maintain the sheet orientation as it is transported by the side rollers 24a, 24b, by guiding the shoulder without exerting any lateral pull that might skew the sheet.

At this stage, the turned over leading end of the sheet is engaged by upper transport path rollers 24a, 24b, while the trailing rear edge of the sheet is still engaged by lower transport roller 23c. As the sheet leaves roller 23c, its front end shoulder moves along the third and final portion 34c of the roll bar. This portion angles outwardly to the right, so that as the sheet advances the trailing left underside of the sheet is drawn over the roll bar, completing the side-to-side turnover of the sheet. The edge 18a is held straight all the while by rollers 24a, 24b, so that the completely inverted sheet is then traveling with the correct alignment when it is engaged on both sides by double drive rollers 24c at the output. As the sheet continues to travel, the trailing left undercorner is brought entirely around so that the full sheet lies flat and inverted on the upper guide plate 36. In this manner, the sheet is inverted as it travels along a substantially straight line direction, without switchbacks or branches. The total path length is approximately two to three sheet lengths, about the same as the path length through a typical print engine, so the sheet inverter may conveniently reside above, adjacent to, or below the engine, connected via a switched sheet deflector or simple relay transport.

Figure 4:
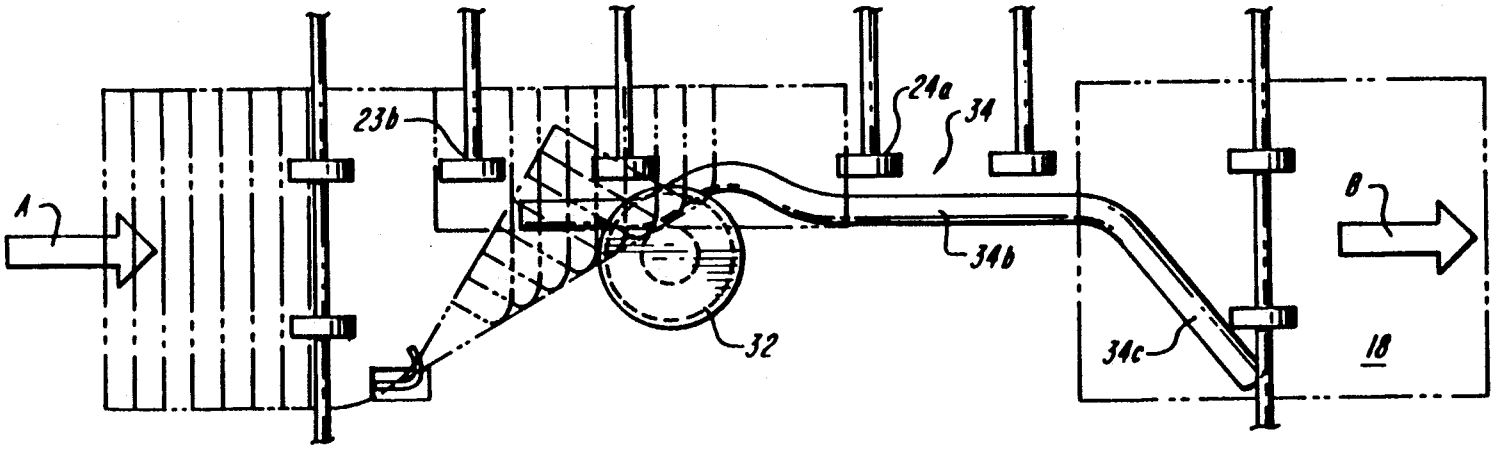
FIG. 4 is a top plan view and partially schematic view showing operation of the mechanism of FIG. 3.
Figure 5:
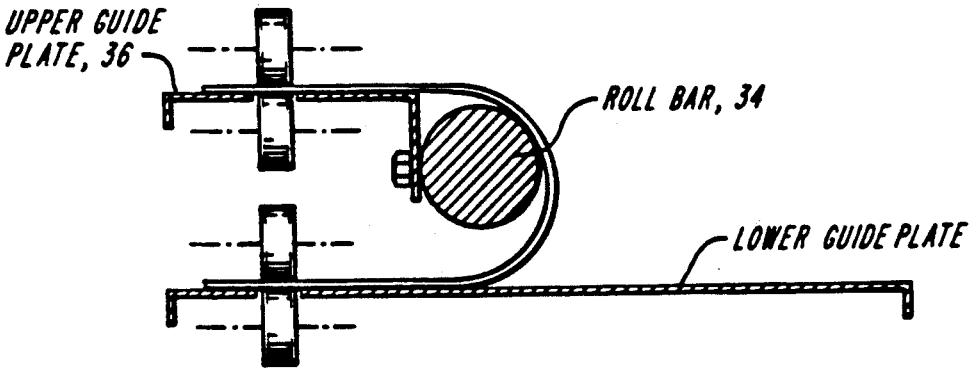
FIG. 5 is a cross section of a sheet in transit over the roll bar element illustrated in FIGS. 3 and 4.
Figure 6:
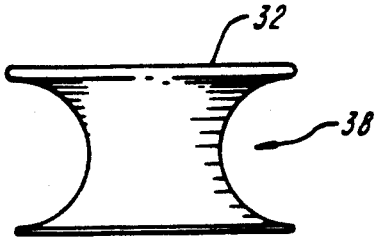
FIG. 6 shows the profile of a curl guide depicted in FIGS. 3 and 4.

FIG. 4 shows a top plan view, partly schematic, of the transport mechanism and sheet progression as illustrated in FIG. 3. As seen in this top view, the roll bar 34 hooks outwardly at its proximal end 34a to urge the shoulder of the curling sheet into the channel 38 of roll guide 32, which, in turn, is positioned essentially at the centerline of the sheet. Thus, just before the sheet 18 leaves drive roller 23b its leading edge arrives at the straight portion 34b of the roll bar and its middle portion is urged into the channel 38 of the roll guide (FIG. 6), so that the free trailing edge follows and the curling shoulder extends essentially straight parallel to the transport path. This positions the sheet straight, so it travels thus bent into a U-shape as shown in FIG. 5 over the initial output drive rollers 24a, 24b until its leading edge commences to uncurl over the outwardly-angled uncurling bar 34c at the end of roll bar 34. At that time it remains engaged by at least two output drive rollers, so it does not get pulled out of alignment as the sheet is drawn over the oblique portion 34c of the roll bar.

The sheet turnover mechanism as just described can extend in a straight path between the output of one printer and the sheet input of a second printer, which is to print a second image on the turned-over side. In a preferred embodiment, however, the mechanism is positioned between output and input of a single print engine, preferably an engine of a type which uses electrographic control signals to form an image. The image signals are changed for each pass of the sheet so that after the sheet has been fed through once, the turnover mechanism inverts it to receive a second image on its other side. A preferred electrographic printer for implementing a system of this type is a so-called "ionographic" printer, of the type described, for example, in U.S. Pat. Nos. 4,160,257, 4,992,807, or the like. Magnetic or laser printers, pin array printers, or copier machines having photoconductive imaging members may also be used.

A further preferred embodiment of a printing system utilizing the sheet turnover mechanism of the present invention performs multipass printing on one or both sides of the sheet, utilizing the mechanism of FIG. 3 with a parallel non-inverting input transport 21b as shown in FIGS. 1 and 2. A logic unit controls a path switching element at the output of the printer to feed a sheet to path 21b if further printing is to be performed on the same side, and to path 21a if the next printing operation is to be performed on the other side of the sheet. The further printing operation on the same side may be, for example, a highlight color printing, a magnetic toner character printing as for a check code printing operation, or printing of an additional color of a multipass color printing operation. In another embodiment, a second pass printing with the same color is used to extend the contrast or density range of a one-color printing process.

It will be appreciated that the sheet turning mechanism as described above has a straight-through short path geometry adaptable to many printer configurations, and that the invention contemplates diverse systems containing one or more printers, interconnected by one or more such transport mechanisms, to effect plural different printing operations on a single sheet. Further, the basic mechanical arrangement of elements in the transport assembly may be varied by substitution of equivalent elements. For example, the input sheet transport may be positioned above the output sheet path, rather than below it, with the elements arranged to curl a sheet downwardly into the output path. Drive belts may replace the rollers for contacting the sheet at one or more positions, and the guide plates may be modified in shape or even replaced with other types of guiding or channeling elements. Systems may be configured with multiple print engines and different path-changing options.

This completes a description of the transport according to the present invention, and an illustrative printing system utilizing that transport. The invention in these embodiments being thus shown and described, various modifications and improvements will occur to those skilled in the art, and all such modifications and improvements are considered to be within the scope of the invention, as defined by the claims appended hereto.

What is claimed is:

1. A side to side sheet inverter for turning a sheet over to face an opposite direction while preserving its end-to-end orientation, such inverter comprising a linearly extending channel having a plurality of drive means extending into the channel for engaging a sheet and transporting the sheet therealong first deflector means for deflecting a leading edge corner of the sheet upwardly and bending the corner over as the sheet is transported along the channel so that the sheet is curled over side-to-side first drive means for gripping a side of the sheet opposite said corner to drive the sheet past the first deflector means second drive means for gripping and driving the leading edge to drive the sheet along the channel, and second deflector means for engaging the sheet at a bend as the sheet is driven by said second drive means, said second deflector means angling outwardly to an edge such that as the sheet is transported its trailing edge is pulled around the bend inverting the sheet.

2. A sheet inverter according to claim 1, wherein the first and second drive means are located at different first and second levels of said channel.

3. A sheet inverter according to claim 1, wherein the second deflector means includes a roll bar having a portion oriented along the length of said channel for initially engaging the sheet, and a portion angled outwardly for flipping the trailing edge of the sheet.

4. A sheet inverter according to claim 1, wherein the drive means includes pairs of rollers projecting into the channel for gripping the sheet in a nip of each pair.

5. A printer system having a print drum past which a sheet is transported in a single direction a number of times for printing one or more different toners on one or more sides, and having inlet and outlet sheet transports, such printer system being characterized by a return transport extending from said outlet sheet transport to said inlet sheet transport, wherein the return transport comprises a linearly extending channel having a plurality of drive means extending into the channel for engaging a sheet and transporting the sheet therealong first deflector means for deflecting a leading edge corner of the sheet upwardly and bending the corner over as the sheet is transported along the channel so that the sheet is curled over side-to-side first drive means for gripping a side of the sheet opposite said corner to drive the sheet past the first deflector means second drive means for gripping and driving the leading edge to further drive the sheet along the channel, and second deflector means for engaging the sheet at a bend as the sheet is driven by said second drive means, said second deflector means angling outwardly to an edge such that as the sheet is transported its trailing edge is pulled around the bend inverting the sheet, whereby a sheet transported by the outlet sheet transport to the return transport is inverted side-to-side as it travels to the inlet sheet transport.

6. A printer system according to claim 5, wherein the return transport further comprises diversion means for diverting the sheet prior to reaching the first deflector means so that the sheet is delivered to said inlet sheet transport without being inverted.

7. An inverting sheet transport, comprising infeed means for feeding in a sheet along an infeed path curling means in the infeed path for curling the sheet over side to side as it is fed by the infeed means outfeed means for engaging a portion of the sheet curled over by the curling means and further feeding the sheet along an outfeed path, and straightening means extending from said infeed path to said outfeed path for straightening the sheet as it is further fed along the outfeed path, the curling means curling a portion of said sheet over the straightening means and the outfeed means thereafter engaging said portion to draw a trailing end of the sheet over said straightening means.

8. The sheet transport of claim 7 wherein the straightening means includes a bar angled outwardly along the outfeed path, the curling means curling the sheet over said bar such that a trailing edge is drawn over the bar to uncurl the sheet as the sheet is fed along the outfeed path.

9. The sheet transport of claim 7, further comprising a non-inverting sheet transport for bypassing at least said curling means and said straightening means, and feeding the sheet directly to said outfeed means.

10. The sheet transport of claim 7, further comprising a printer having a sheet input and a sheet output, the sheet output being connected to the infeed means and the outfeed means being connected to the sheet input whereby a sheet printed by the printer is returned inverted to the printer for further printing.

11. The sheet transport of claim 9, further comprising a printer having a sheet input and a sheet output, means for connecting the outfeed means to the sheet input, and means for selectively connecting the sheet output to the infeed means or to the non-inverting sheet transport, whereby a sheet printed by the printer on one side, is selectively redelivered to the sheet input for further printing on the same or another side.

12. An inverting sheet transport assembly comprising:

an inlet first drive means for driving a sheet along a first transport path from said inlet paper curler means extending into the first transport path for curling over at least an edge portion of the sheet as it is driven by the first drive means so that the curled-over edge portion extends into a second transport path leading to an outlet second drive means for engaging the sheet and driving the sheet along the second transport path, and guide means for smoothly guiding the sheet to entirely curl over, inverting the sheet from side-to-side as it is transported to and along said second transport path, said first and second transport paths being parallel to each other and vertically offset at different levels such that the sheet moves along a substantially straight path and is inverted side to side as it is transported between the inlet and the outlet.

* * * * *